United States Patent [19]

Collinet et al.

[11] Patent Number: 4,477,788

[45] Date of Patent: Oct. 16, 1984

[54] DIELECTRIC RESONATOR TUNER AND MECHANICAL MOUNTING SYSTEM

[75] Inventors: Jean C. Collinet, Georgetown; Mark V. Slyke, Arlington, both of Mass.

[73] Assignee: M/A Com, Inc., Burlington, Mass.

[21] Appl. No.: 463,348

[22] Filed: Feb. 3, 1983

[51] Int. Cl.[3] ..... H01P 7/10; H01P 1/203

[52] U.S. Cl. ..... 333/235; 333/202; 333/205; 331/107 SL

[58] Field of Search ..... 333/202, 204–205, 333/208–212, 219, 227–233, 235, 245, 246; 331/96–102, 107 DP, 107 SL; 29/600

[56] References Cited

U.S. PATENT DOCUMENTS 4,019,161 4/1977 Kimura et al. ..... 333/235 X 4,028,652 6/1977 Wakino et al. ..... 333/235 X

*Primary Examiner*—Marvin L. Nussbaum

*Attorney, Agent, or Firm*—Wolf, Greenfield & Sacks

[57] ABSTRACT

A combined mounting and tuning structure for a dielectric resonator comprised of a stack of a dielectric resonator body, a resilient body of dielectric material and an electrical tuning conductor. A fastening means preferably in the form of a dielectric screw threadedly engaged in a base wall of an enclosure and by turning the fastening means, the tuning conductor is brought closer to the resonator, and the resonant frequency of the resonator is thereby adjusted while also providing a clamping force on the stack so as to maintain its position relative to the base wall. The dielectric resonator tuner of the invention is shown in oscillator and filter circuit embodiments.

11 Claims, 7 Drawing Figures

DIELECTRIC RESONATOR TUNER AND MECHANICAL MOUNTING SYSTEM

Background of the Invention

The present invention relates in general to dielectric resonators. More particularly, the invention pertains to a mounting and tuning structure for a dielectric resonator.

The construction of a prior art dielectric resonator is described in detail hereinafter ad is illustrated in two different embodiments. Briefly, the prior art dielectric resonator is fastened to a dielectric circuit board such as with an epoxy cement; which circuit board carries conductor strips. The circuit board and components carried on it are located within an electrically-conductive enclosure. Tuning means are typically provided opposite to the circuit board for tuning the resonant frequency of each of the dielectric resonators that might be employed. While the tuning means that is employed may differ in some details, each typically has an electrically conductive plate or disc adjacent one of the resonators which can be moved relative to the dielectric resonator and which is accessible for adjustment for outside of the enclosure. In the construction of the resonator, adjustments are usually fixed such as with an epoxy cement, in a holding structure which may include, for example, a locking nut in one embodiment.

In the prior art, the dielectric resonator has to be located at an approximate frequency prior to closing the enclosure, and mechanical tuning is accomplished from outside of the enclosure. One of the disadvantages with this prior art arrangement is that the locking of a setting with a nut or screw and with cement is unreliable. Furthermore, the setting is too easily disturbed by handling of the device and is subject to tampering. Also, some prior techniques for locking a setting have been expensive.

Summary of the Invention

Accordingly, it is an object of the present invention to provide an improved tuning structure for a dielectric resonator in which the tuning occurs internally of the enclosure and before the enclosure is closed or sealed. In this way, the closing of the unit substantially totally eliminates any external tampering with the tuning structure.

A further object of the present invention is to provide an improved mounting and tuning structure for a dielectric resonator in which the enclosure cover has no holes therethrough as in prior constructions and thus no tuner leakage. In accordance with the invention the stability of the device is increased due to a fixed tuner being employed and one which is tamper proof.

Another object of the present invention is to provide a combined mounting and tuning structure that is less expensive than prior art constructions. Without the use of an external metal tuning screw or the like, there is a cost saving.

To accomplish the foregoing and other objects of this invention there is provided a combined mounting and tuning structure for a dielectric resonator comprising a base and a stack arranged on the base including a dielectric resonator body, a resilient body of dielectric material, and an electrical conductor. Means are provided for fastening the stack base with the resilient dielectric between the resonator body and the electrical conductor. The fastening means is adjustable to provide both tuning of the resonant frequency of the resonator and also at the same time providing a clamping force on the stack so as to maintain its position relative to the base. The stack preferably has a hole therethrough and the adjustable fastening means preferably comprises a screw threadedly engaged in the base and having a head for providing the necessary clamping force. The base is preferably electrically conductive and the screw preferably a dielectric screw. In addition to showing the use of the dielectric resonator tuner in a microwave circuit, there is also described a dielectric resonator-tuned gun oscillator constructed in accordance with the invention, a dielectric resonator stabilized FET oscillator constructed in accordance with the invention and a dielectric resonator filter constructed in accordance with the invention.

Brief Description of the Drawings

Numerous other objects, features and advantages of the invention should now become apparent upon a reading of the following detailed description taken in conjunction with the accompanying drawing, in which.

Detailed Description of the Drawings

Figure 1:
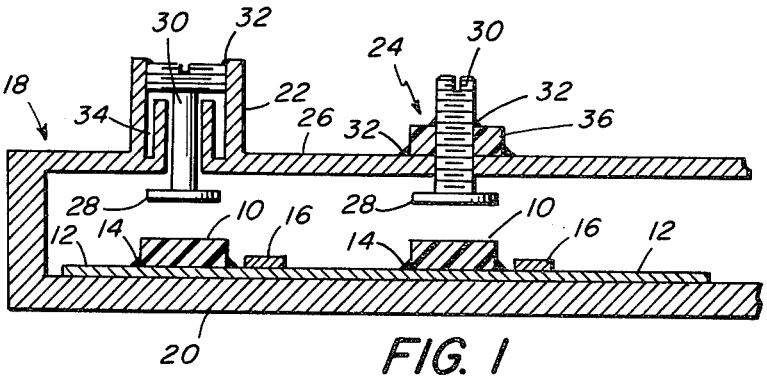
FIG. 1 illustrates a typical prior-art dielectric resonator tuner in a microwave circuit.

In the prior art as illustrated in FIG. 1 a dielectric resonator 10 is fastened to a dielectric circuit board 12 with a cement 14, such as epoxy, adjacent to a strip-line conductor 16 which is carried on the board. Two such resonators are shown, for purposes of illustration. The board and components carried on it are located within an electrically-conductive enclosure 18, on a surface of one wall 20 of the enclosure. Tuning means 22, 24, for example, are provided in the opposite wall 26 of the enclosure for tuning the resonant frequency of each of the dielectric resonators. While the tuning means 22, 24 may differ in some details, each has an electrically-conductive plate or disc 28 adjacent one of the dielectric resonators 10, which can be moved relative to the dielectric resonator on a stem 30 which is accessible for adjustment from outside the enclosure 18. Typically in the prior art, adjustments are fixed with epoxy cement 32, in a holding structure which may involve, in one case 22 a choke housing 34, and in the other case 24 a locking nut 36 which also must be fixed with cement.

In the prior art, the dielectric resonator 10 has to be located to an approximate frequency prior to closing the enclosure 18, and mechanical tuning is done from outside the enclosure. Locking a setting with a nut, or screw, and with cement, is unreliable, is subject to being disturbed by handling the device, and subject to tampering. It is also expensive.

Figure 2:
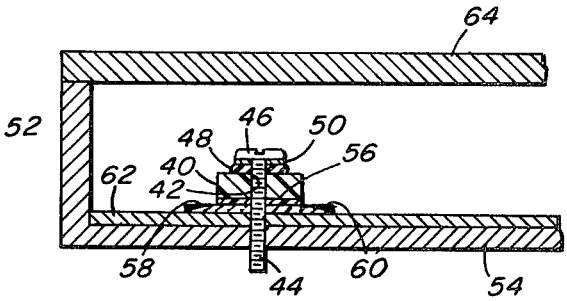
FIG. 2 illustrates a dielectric resonator tuner according to the invention in a microwave circuit.

According to the invention as illustrated in FIG. 2, a dielectric resonator 40 has a hole 42 through it for passage of a dielectric screw 44, for example nylon, having a flat head 46. The screw is used to fasten a stack 66 composed of the resonator 40, a resilient dielectric (e.g.: rubber) body 48 and an electrical tuning conductor 50 to the base wall 54 of a container 52 made of electrically-conductive material such as aluminum. The screw 44 is threadedly engaged in the base wall 54, and by turning the head 46 the tuning conductor 50 is brought closer to the resonator 40, and the resonant frequency of the resonator 40 is thereby adjusted while also providing clamping force on the stack 40-48-50 so as to maintain its position relative to the base wall 54. Desirably the electrical tuning conductor 50 is a belleville washer. As illustrated a thin washer 56 of dielectric material (e.g.: "Mylar"—a polyethylene terephthalate film) is located beneath the stack, and the entire stack rests on two strip-line conductors 58, 60, on a dielectric circuit board 62, the resonator being thereby coupled to the strip-line conductors.

After the resonator has been tuned and clamped to the base wall 54, a cover 64 is placed on the container 52, and the excess of the fastener screw 44 which protrudes through the base wall 54 may be cut off with a sharp instrument. The tuned resonator is now completely enclosed, shielded from maladjustment due to handling, from R.F. leakage, and from tampering. It is also less expensive than the prior art tuning mechanisms.

Figure 3:
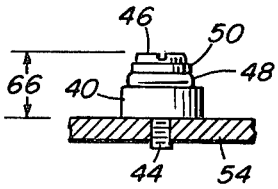
FIG. 3 shows a basic components of a dielectric tuner according to the invention.

As is shown in FIG. 3, the basic components of a dielectric tuner according to the invention are the dielectric resonator 40, resilient dielectric body 48 and electrical tuning conductor 50, in a stack 66 fastened to the base 54 with a clamp 44–46 of dielectric material. Preferably the clamp is a screw made of a low-K dielectric which will aid in achieving a high Q for the resonator, and the resilient body 48 is a non-conductive, compressible "O"-ring. The dielectric resonator may be made of barium tetratitanate, as has been mentioned in the introduction.

The hole in the resonator (e.g.: hole 42 shown in FIG. 2) is useful to displace spurious responses from the desired frequency band, as well as for passage of the screw 44. The base 54 need not be an electrical conductor; its mounting and clamping function may be provided by a dielectric circuit board on which strip-line conductors are also carried.

FIGS. 4–7, inclusive, illustrate uses and applications for the improved dielectric resonator of the invention.

Figure 4:
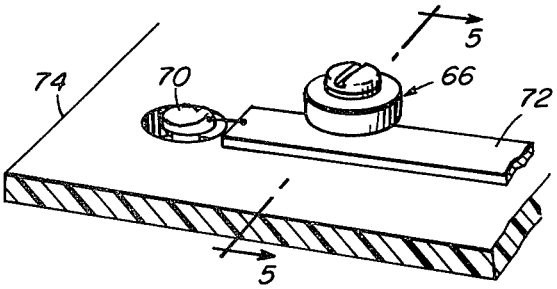
FIG. 4 illustrates a dielectric resonator-tuned Gunn oscillator according to the invention.
Figure 5:
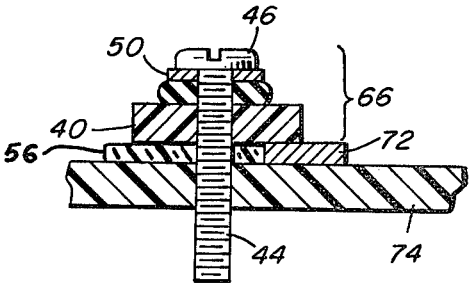
FIG. 5 is a section on line 5—5 in FIG. 4.

FIGS. 4 and 5 show a typical dielectric resonator oscillator. The dielectric resonator stack 66 acts similar to a resonate cavity, namely, a high-Q temperature stable cavity. The frequency of the oscillator is uniquely determined by the physical and electrical characteristics of the dielectric resonator, and by the position of the dielectric resonator with respect to the active device, which in this illustration is a gunn diode 70. The resonator 40 is typically designed to resonate several Mega Hertz below the specified center frequency along the output microstrip line 72. The stack 66 is designed to tune and trim the resonator to achieve the exact center frequency. It will hold the resonator 40 solidly against the circuit board 74 while providing 2%–10% frequency tuning. The amount of tuning is proportional to the physical size of the conductive washer 50 and its distance from the dielectric resonator 40.

Figure 6:
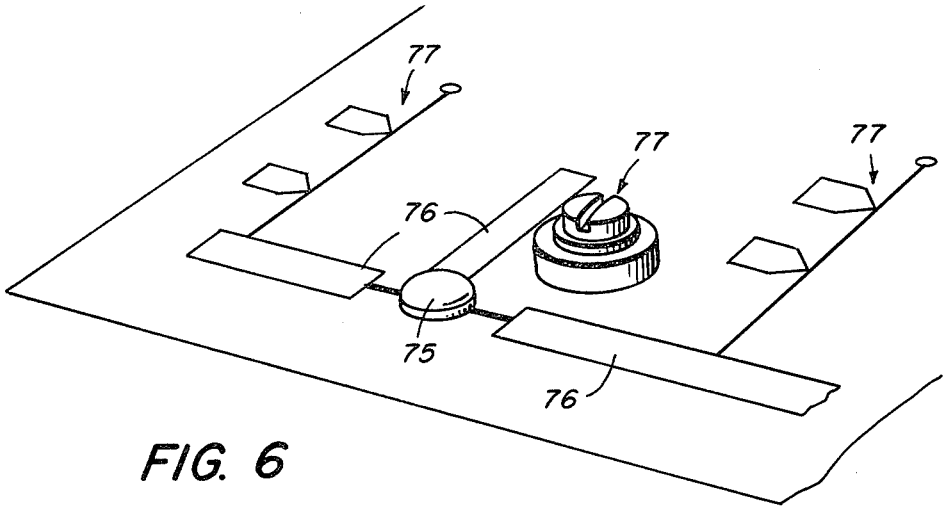
FIG. 6 schematically illustrates a dielectric resonator stabilized FET oscillator according to the invention.

FIG. 6 shows a generalized dielectric resonator-stabilized FET oscillator. As with the gunn oscillator in FIG. 4, the resonator characteristics, and position relative to other components, determine the oscillating frequency. Given all the non-constant factors of such a circuit, the dielectric resonator needs some frequency tuning to bring it exactly on frequency. This invention provides solid mounting while providing 2%–10% frequency tuning of the resonator.

The generalized dielectric resonator-stabilized FET oscillator of FIG. 6 comprises the FET transistor 75 coupling to conductor strips 76 by way of terminal leads from the transistor. Bias lines 77 couple to two of the conductor strips as illustrated. The dielectric resonator stack 78 is shown positioned in proximity to the FET transistor 75.

Figure 7:
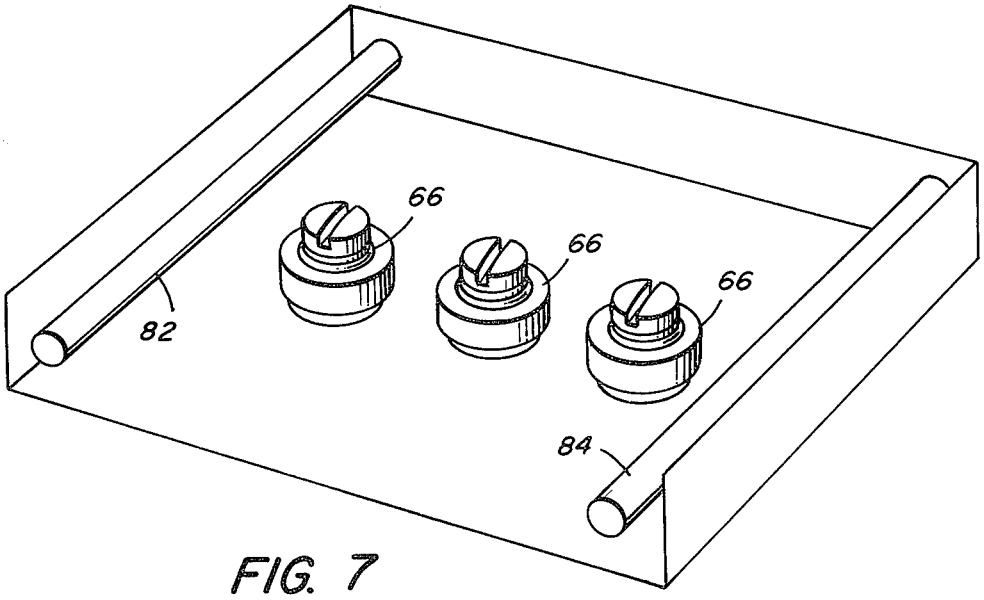
FIG. 7 schematically illustrates a dielectric resonator filter according to the invention.

Dielectric resonator filters are ideal for high Q, narrow band-pass filters. A good example of such an application is in the 4.7–5.2 GHz telecommunication frequency band. Instead of using large, bulky cavity filters, a more compact inexpensive dielectric resonator according to the invention can be employed as a filter. A number of dielectric resonator stacks 66 can be placed in close proximity to each other, to provide the necessary resonator-to-resonator coupling to achieve the proper filter characteristics, as is shown in FIG. 7. The RF energy is coupled into and out of the filter via suitable transmission lines 82, 84 which can take any desired form. The band center and ripple frequencies can be approximated by resonator characteristics and relative placement (hence, relative couplings). Once built, the filter will need some adjustments to bring the band center, roll off, and ripple frequencies to their exact specifications. This invention provides the ideal solution to this "tweeking". If tuning is allowed to be done from outside the enclosure, each resonator can be tweeked in frequency separate from the other resonators with the cover on, sealed, and while running on a network analyzer.

Having described one embodiment of the present invention, it should now be apparent to those skilled in the art that numerous other embodiments are contemplated as falling within the scope of this invention.

What is claimed is:

1. A combined mounting and tuning structure for a dielectric resonator comprising a base, in a stack on said base a dielectric resonator body, a resilient body of dielectric material and an electrical conductor, and means to fasten said stack to said base with said resilient dielectric between said resonator body and said electrical conductor, said fastening means being adjustable to provide a variable clamping force on said stack so as to tune the resonating frequency of said resonator body.

2. A mounting and tuning structure according to claim 1 having a hole through said stack and in which said adjustable fastening means is a screw threadedly engaged in said base said screw having a head for providing said clamping force.

3. A mounting and tuning structure according to claim 2 in which said base is electrically-conductive and said screw is a dielectric.

4. A mounting and tuning structure according to claim 1 including an enclosure attached to said base, surrounding said mounting and tuning structure.

5. A mounting and tuning structure according to claim 4 in which said enclosure and said base are electrically conductive, and said fastening means is dielectric.

6. A mounting and tuning structure according to claim 3 including an electrically-conductive enclosure attached to said base, surrounding said stack and said screw, whereby to prevent said clamping force from being altered.

7. A mounting and tuning structure according to claim 3 including a further dielectric layer between said resonator and said base.

8. A mounting and tuning structure according to claim 1 including strip-line conductor means on said base under said stack.

9. A mounting and tuning structure according to claim 8 including a further dielectric layer between said resonator and said strip-line conductor means.

10. A mounting and tuning structure according to claim 8 wherein said another circuit comprises an oscillator circuit.

11. A mounting and tuning structure according to claim 8 wherein said another circuit comprises a filter circuit.

* * * * *